United States Patent [19]
Stone et al.
[11] 4,262,910
[45] Apr. 21, 1981

[54] DARTBOARD

[75] Inventors: James H. Stone, Burgh-Le-Marsh, near Skegness; Stephen H. Stone, Skegness, both of England

[73] Assignee: Dunlop Limited, London, England

[21] Appl. No.: 30,385

[22] Filed: Apr. 16, 1979

[30] Foreign Application Priority Data

Apr. 25, 1978 [GB] United Kingdom ..... 16211/78

[51] Int. Cl.[3] ..... F41J 3/00
[52] U.S. Cl. ..... 273/408
[58] Field of Search ..... 273/102 B, 403, 404, 273/408

[56] References Cited

U.S. PATENT DOCUMENTS 2,076,357 4/1937 Tempest ..... 273/102 B

FOREIGN PATENT DOCUMENTS 325117 2/1930 United Kingdom ..... 273/102 B
406400 3/1934 United Kingdom ..... 273/102 B
487183 6/1938 United Kingdom ..... 273/102 B
504959 5/1939 United Kingdom ..... 273/102 B
525369 8/1940 United Kingdom ..... 273/102 B

*Primary Examiner*—Anton O. Oechsle
*Attorney, Agent, or Firm*—Stevens, Davis, Miller & Mosher

[57] ABSTRACT

The invention provides a dartboard having a wire grid defining the target areas which enables finer wire than conventional to be used. The grid consists of straight high tensile radial wires and arcuate high tensile wires with bent ends pushed into the dartboard adjacent the radial wires to define the target areas within the sectors defined by the radial wires. Each ring of the target areas can conveniently be made up of a series of separate arcuate wires with bent ends and each radial wire can similarly be attached to the board by having bent ends. The radial wire can lie in the V-grooves between the upper ends of the legs of adjacent arcuate wires. Thus the grid can be a collection of separately-removable units for repair or replacement.

6 Claims, 3 Drawing Figures

DARTBOARD

This invention relates to dartboards and is particularly concerned with providing a dartboard of high quality, particularly suitable for match play.

The conventional dartboard is formed of bundles of sisal fibres compressed together and glued with the fibres end on to a circular back board and all enclosed within a metal band, the target areas being defined by a wire grid stapled to the compressed fibres and consisting of twenty straight round wires radiating from the outer of a pair of concentric central round wire circles (defining the "bull's eye" or "bull" and a surrounding area of lesser value or "outer bull") and intersecting further pairs of round wire circles (defining the "treble" and "double" areas of the twenty sectors of the remaining playing area) and the values (i.e. numbers) of the sectors being defined by round wire numerals attached to a wire rim adjacent the edge of the dartboard and also stapled to the compressed fibres (e.g. by over 60 staples).

Although the wires are comparatively small in diameter, nevertheless, because they have to be of adequate strength, they (and the staples securing them) obscure a significant proportion of the target areas and the surrounding "non-playing" area, and thus present obstruction to darts, which not infrequently strike the wires, become damaged, and bounce off (thereby not contributing to the score and possibly—and more importantly—becoming unfit for further use), and the wires soon become deeply embedded in the said fibres and possibly also bent, so that the target areas become of unequal size and unclear to a player at the position from which the darts are required to be thrown. In addition the board is damaged to a far greater extent by penetration by bent wires than by any amount of penetration of dart points.

In a matter of days a dartboard can become unfit for match play, and in a matter of weeks completely unfit for any serious use. The time within which a dartboard becomes unfit for use is always also shortened by concentration of darts on one particular target area (e.g. the "20" sector), and rotation of the wire rim to relocate the wire numerals (with appropriate rotation of the whole board to restore the spatial disposition of the numbers) affords only a very temporary prolongation of the life of the board.

One object of the invention is to provide a dartboard with very clear and accurate definition of the target areas.

Another object is to provide means for defining the target areas which greatly reduces the possibility of any dart on target not entering an area and bouncing back.

A further object is to provide means for defining the target areas which reduces the possibility of causing damage to darts.

With these objects in view it has been previously proposed to provide a dartboard with a grid of strip-like partitions defining the target areas, with each partition formed with a "knife-edge" presented at the surface of the compressed fibres. The expression "knife-edge" does not denote an edge capable of cutting but one with no appreciable surface area parallel to the surface of the compressed fibres, and each "knife-edge" was proposed to be very slightly rounded, so as not to present a thin edge that can be burred over by impact from the leading end of the body of a dart overdriven into the board. In order to mount the grid on the dartboard without using staples it was proposed to press it into the compressed fibres until only about 1.5 mm of some 6 mm protruded, the opposite edges of the partitions also being "knife-edges" (as described above) to assist in the embedding of the grid into the compressed fibres.

However, the proposed grid as described above proved to have certain disadvantages, the most notable being that the increase in the compression of the fibres resulting from the pressing in of the grid, especially in the smaller areas made it progressively more difficult for darts to enter the board as the fibres became bent by darts entering the board. Attempts have been made to overcome this difficulty by grooving the dartboard to receive the grid or by forming the dartboard in sections or segments to fit within the grid, but these solutions call for considerable accuracy in the positions and sizes of the grooves or the shapes of the sections or segments, thus adding appreciably to the cost of production. Another approach has been to try a wide variety of different materials in place of the sisal fibres, such as wood, cork, "Plasticine" (Registered Trade Mark), and expanded polyethylene, but none has shown any worthwhile improvement over sisal fibres.

More recently, it has been proposed to use polypropylene filaments in place of sisal fibres but while the indication is that a dartboard of polypropylene filaments will be more durable than one made of sisal fibres, all the aforementioned difficulties attendant upon trying to fit a grid of strip-like partitions into a dartboard of sisal fibres are again encountered when trying to fit such a grid into a dartboard of polypropylene filaments.

According to the present invention, therefore, a dartboard comprises a grid consisting of straight high tensile radial wires between an inner ring (e.g., denoting the outer limit of the "outer bull") and an outer ring which encloses the playing area, and arcuate high tensile wires with bent ends pushed into the dartboard adjacent the radial wires to define the rings of the target areas (e.g., the "trebles" and "doubles") within the sectors defined by the radial wires.

Thus both the radial and the arcuate wires can be formed of very fine high tensile wire (such as diamond-drawn stainless steel wire) so as to clearly and accurately define the target areas, more particularly any specific target area hit by any one dart, with considerably reduced risk of a dart hitting a wire and bouncing back. Although any of the wires may be deflected (especially the longer lengths of the straight wires) by up to the maximum radius of a dart point, this deflection will be negligible and the deflected wire will spring back to its initial position immediately after the dart point is withdrawn from the board.

In a preferred embodiment each ring of the grid including the outer ring (but excluding the inner ring) is made up of a series of separate arcuate wires with bent ends pushed into the dartboard adjacent the radial wires. Conveniently each arcuate wire is of length to lie between an adjacent pair of radial wires. Each radial wire can then lie in the small gap between adjacent arcuate wires of any ring or can lie in the V-grooves formed between adjacent legs of adjacent arcuate wires.

The radial wires may be welded or bonded to the inner and outer rings whilst held under tension; and each pair of diametrically opposed radial wires may be formed by a single wire stretched right across from one side of the outer ring to the opposite side, welded or bonded at the two places to the outer ring and at the two intersections with the inner ring, and then cut away from within the inner ring. However it is preferred that the radial wires also have bent ends which can be pushed into the dartboard adjacent the inner and outer rings. Thus in a particularly preferred embodiment, each radial wire of the dartboard is a separately removable entity and each arcuate wire extends only from one radial wire to the adjacent radial wire. It may be found necessary, where a radial wire is pinned to the board by a bent leg at each of its extremities, to use a staple in an intermediate position along the length of the wire to ensure it is sufficiently stable in the desired position. However, in view of the very fine nature of the wires that can be utilised by the present invention, such staples may correspondingly be of relatively small size compared to conventionally-used staples and hence cause no appreciable obscuring of target area.

The inner ring may be a wire ring or it may be a cylindrical ring formed of high tensile strip (which may be provided with "knife-edges" to present at the surface of the board an edge as fine as the straight high tensile wires and to assist in embedding of the ring in the board), in which case holes or notches may be provided in the edge of the inner ring adjacent to the surface of the board for location of the radial wires, which may have bent ends to engage against the inside of the inner ring. As indicated above, the outer ring is preferably a wire ring, but it too may be a cylindrical ring formed of high tensile strip (which may be provided with "knife-edges"), which may also be provided with holes or notches in the edge adjacent to the surface of the board for location of the straight wires.

The outer ring may be the perimeter of the dartboard; or it may be the perimeter of the playing area, with an annular portion of the board between the outer ring and a peripheral band of the board bearing the numerals relevant to the sectors defined by the straight wires, which numerals may be formed from high tensile wire with bent ends pressed into the board (or annular portion thereof) or may be painted or printed thereon.

The arcuate wires forming one limit of any concentric ring of target areas may have their adjacent bent ends welded or bonded together, so that a complete ring is formed with integral fixing "legs", and the straight wires may be welded or bonded into V-grooves formed at the junctions of the adjacent bent ends of the arcuate wires and the arcuate portions.

However, as indicated above, it is preferred that the arcuate wires are separable from each other and also it is preferable that the radial wires are not bonded to the arcuate wires. This has the important advantage that, should a wire be bent or otherwise damaged, it can be removed from the board by prising its legs out. A bent wire can be straightened and put back into position or a replacement wire can be inserted with a minimum of difficulty and there is no need for the whole wire grid to be removed. That is a particularly useful feature in that it enables much finer wire to be used than can be used in the grid of a conventional dartboard. It will be readily appreciated that the finer the wire, the less chance there will be of a dart hitting the wire. However, even very fine wire will occasionally receive a direct hit and because of its fineness it is more likely to be bent or kinked by a direct hit. Hence if very fine wire were to be used in a conventional grid, it would from time to time be necessary to remove the complete grid for repair of replacement and clearly this would be unacceptable during play. This disadvantage does not arise with dartboards of the present invention since an individual arcuate or straight wire can be readily removed for replacement or repair, A "bull" may be defined by a wire ring, or by a cylindrical ring with "knife-edges", and the "bull" and the "outer bull" may be formed by a separte disc and an annular portion respectively of the board material.

Preferred high tensile wires for use in the invention have diameters in the range 0.020 inch (0.50 mm) to 0.040 inch (1.0 mm), 0.025 inch (0.63 mm) to 0.036 inch (0.90 mm) being especially advantageous.

A preferred embodiment of the invention is illustrated by way of example only with reference to the accompanying drawings in which.

Figure 1:
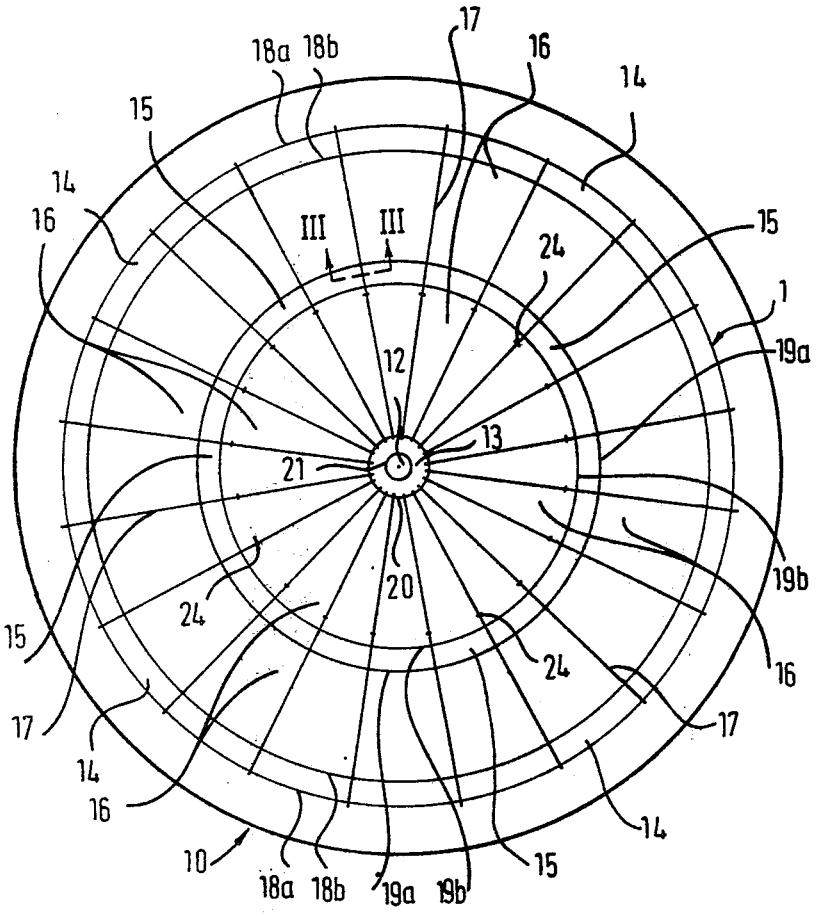
FIG. 1 is a plan view of a dartboard of the invention without numbers.

In FIG. 1, dartboard 10 has a grid 11 defining the target areas. The target areas are the inner bull 12, outer bull 13, doubles 14, trebles 15 and singles 16. These areas are defined by straight radial wires 17, double arcuate wires 18*a* and 18*b*, trebles arcuate wires 19*a* and 19*b*, the outer bull ring 20 (which is the inner ring of the claims below) and an inner bull ring 21. Each radial wire 17 has a staple 24 holding it to the dartboard in an intermediate position along its length.

Figure 2:
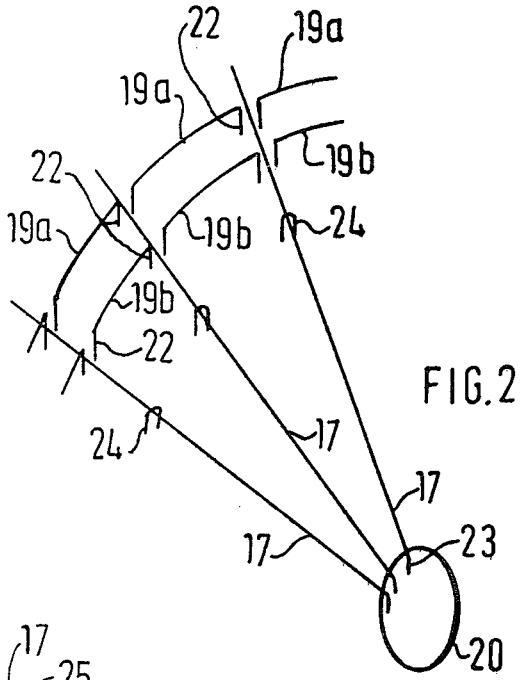
FIG. 2 is a representation in exploded form of a portion of the wire grid of FIG. 1.

As can be seen from the exploded partial view of the grid in FIG. 2, each treble area is bounded by a pair of independent arcuate wires 19*a* and 19*b* which lie between a pair of adjacent radial wires 17. Each arcuate wire has a leg 22 at each end of its length, the leg having been formed by bending over the end of the wire. The pair of legs enable each arcuate wire to be pressed firmly into the board to hold it in the desired position. The doubles areas (not shown in FIG. 2) are constructed in the same manner. Each radial wire 17 also has a leg 23 at each end formed by bending over the end of the wire. The inner leg of each wire 17 is pressed into the board just inside ring 20 of the outer bull. The outer leg (not shown in FIG. 2) is pressed into the board outside the ring formed by arcuate doubles wires 18*a*. Staples 24 add additional stability to the radial wires in their pinned position.

Figure 3:
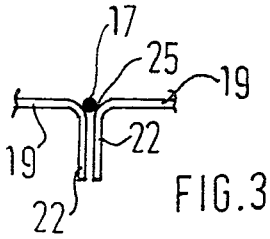
FIG. 3 is a section on line III-III of FIG. 1.

FIG. 3 shows the relative positions of adjacent arcuate and radial wires when pinned to the board. It will be seen that the radial wire 17 rests in the V-grooves 25 defined at the tops of the legs of an adjacent pair of arcuate wires 19.

Having now described our invention-what we claim is:

1. A dartboard having a replaceable wire grid defining target areas, said grid comprising an inner ring and an outer ring which encloses said target areas, straight high tensile radial wires running between said inner ring and said outer ring, and arcuate high tensile wires having bent ends, said bent ends being pushed into the dartboard adjacent said radial wires to define the rings of said target areas within the sectors defined by said radial wires, each of said radial and arcuate high tensile wires being separately removable from said dartboard and having a diameter in the range from 0.020 inch to 0.040 inch.

2. A dartboard according to claim 1, in which said high tensile wires have a diameter of from 0.025 inch (0.63 mm) to 0.036 inch (0.90 mm).

3. A dartboard according to claim 1, in which said radial wires lie in the V-grooves formed between pairs of adjacent legs of adjacent arcuate wires.

4. A dartboard according to claim 1, in which said radial wires have bent ends pushed into the dartboard.

5. A dartboard having a replaceable wire grid defining target areas, said grid comprising an inner ring and an outer ring, said outer ring enclosing said target areas, straight high tensile radial wires running between said inner ring and said outer ring, and arcuate wires, said radial wires and arcuate wires having bent ends pushed into the dartboard, said ends of the arcuate wires being adjacent radial wires to define the rings of said target areas within the sectors defined by said radial wires, each of said radial and arcuate high tensile wires being separately removable from said dartboard and having a diameter in the range from 0.020 inch to 0.040 inch.

6. A dartboard according to claim 5, in which said radial wires lie in the V-grooves formed between pairs of adjacent legs of adjacent arcuate wires.

* * * * *